US008173939B1

(12) United States Patent
Bobgan

(10) Patent No.: US 8,173,939 B1
(45) Date of Patent: May 8, 2012

(54) THERMALLY CONDITIONABLE LIGHT TRANSMITTING SUBASSEMBLY

(75) Inventor: Peter M. Bobgan, Maple Grove, MN (US)

(73) Assignee: Minco Products, Inc., Minneapolis, MN (US)

( * ) Notice: Subject to any disclaimer, the term of this patent is extended or adjusted under 35 U.S.C. 154(b) by 1002 days.

(21) Appl. No.: 12/118,970

(22) Filed: May 12, 2008

Related U.S. Application Data

(60) Provisional application No. 60/928,499, filed on May 10, 2007.

(51) Int. Cl.
*H05B 3/06* (2006.01)
*H01C 1/034* (2006.01)

(52) U.S. Cl. ..... 219/522; 219/202; 219/203; 219/204; 219/205; 219/209; 219/210; 219/213; 219/214; 338/262; 338/315; 338/320

(58) Field of Classification Search ..... 219/522, 219/202–205, 209–10, 213–14, 543; 338/262, 338/315, 320
See application file for complete search history.

(56) References Cited

U.S. PATENT DOCUMENTS

| | | | | |
|---|---|---|---|---|
| 5,380,981 | A * | 1/1995 | Feldman et al. | 219/219 |
| 5,729,003 | A | 3/1998 | Briggs, III | |
| 5,825,474 | A | 10/1998 | Maase | |
| 6,601,983 | B1 | 8/2003 | Runfola et al. | |
| 6,612,493 | B1 | 9/2003 | DeGiovine et al. | |
| 6,727,468 | B1 | 4/2004 | Nemeth | |
| 6,809,303 | B2 | 10/2004 | Carver et al. | |
| 6,866,391 | B2 | 3/2005 | Krausse | |
| 7,023,519 | B2 | 4/2006 | Ho et al. | |
| 7,211,771 | B1 | 5/2007 | Smith et al. | |
| 2006/0060802 | A1 | 3/2006 | Richter et al. | |

* cited by examiner

*Primary Examiner* — Shawntina Fuqua
(74) *Attorney, Agent, or Firm* — Nawrocki, Rooney & Sivertson, P.A.

(57) ABSTRACT

A non-film based, thermally conditionable light transmitting article is provided. The article includes an adhesively coated resistive wire and a substrate suitably selected for light transmittance. The adhesively coated resistive wire is solely and directly adhesively affixed to the substrate so as to be thereby supported upon and by the substrate. A layer of adhesive, in the form of an adhesive linkage originating from the adhesive of the adhesively coated resistive wire, is present between the resistive wire and the substrate.

39 Claims, 1 Drawing Sheet

Plan Full Scale

Plan Full Scale

Detail A

Wire Section View

THERMALLY CONDITIONABLE LIGHT TRANSMITTING SUBASSEMBLY

This is a regular application filed under 35 U.S.C. §111(a) claiming priority under 35 U.S.C. §119(e) (1), of provisional application Ser. No. 60/928,499 entitled "Direct Wire Bonded Thermal Element for the Prevention of Icing and Condensation in Optical Components" filed May 10, 2007, and incorporated herein by reference in its entirety.

TECHNICAL FIELD

The present invention generally relates to the prevention of, or recovery from, a diminished light transmission condition for an optical lens, electro-optical system, viewfinder, "window," etc. owing to condensate formation or the like, more particularly, to a light transmitting subassembly which is thermally conditionable in furtherance of maintaining an operable, advantageous optical system functionality and/or in furtherance of preventing/remedying a diminished optical capacity condition owing to environmental/atmospheric deposition.

BACKGROUND OF THE INVENTION

Systems or devices wherein light (i.e., select forms/wavelengths of electromagnetic energy) is an important consideration, factor, or "input" in furtherance of system or device functionality, or wherein a "view" through a system or device "window" for an assessment of local/distant objects and/or surroundings is essential to system or device function or performance, are well known. Exemplary applications include, but are hardly limited to, imaging systems such as optoelectronic (e.g., U.S. Pat. Appl. Pub. No. US 2006/0060802 A1 (Richter et al.)) and/or biometric (e.g., U.S. Pat. Nos. 6,809,303 B2 (Carver et al.) and 5,825,474 (Maase)), optical scanners/scanning such as bar code readers or the like (e.g., U.S. Pat. Nos. 6,612,493 B2 (DeGiovine et al.) and 5,729,003 (Briggs, III)), light emitting diode (LED) fixtures such as vehicle headlamps (e.g., U.S. Pat. No. 6,601,983 B1 (Runfola et al.)) and/or traffic control signal lights (e.g., U.S. Pat. No. 7,211,771 B1 (Smith et al.)), liquid crystal display (LCD) screens (e.g., U.S. Pat. Nos. 6,727,468 B1 (Nemeth) and 7,023,519 B2 (Ho et al.)), cameras/telescopes/sights/range-finders (e.g., U.S. Pat. No. 6,866,391 B2 (Krausse)), and/or self guided munitions, vehicles, etc.

Whether owing to natural environmental conditions (e.g., ambient atmospheric conditions with regard to use of a telescope, camera, munition guidance system, etc.) or artificial environmental conditions part and parcel of a manufacturing or industrial processes/processing (e.g., refrigerated systems wherein optical scanning is conducted or processes wherein LCD instrumentation is present), optical interference via the formation of condensate and/or ice, whether water vapor or other saturated gaseous element/compound associated with a given process/application, often times renders such systems or devices inoperative, and if not, nonetheless greatly alters system/device performance. Among the heretofore known, well documented approaches to avoid/remedy such diminished capacity, the thermal conditioning of such optical lens, electro-optical system, "windows," etc. appears favored and widely practiced.

One current method to provide thermal energy to an optical lens or window is to apply a resistive heater to its perimeter, leaving the center completely unobstructed (see e.g., Carver et al. '303 FIGS. 5 & 6). This approach relies on thermal energy conducting laterally through the optical lens or window material to provide sufficient heating in the center of the component. Due to the poor thermal-conduction properties of typical optical materials, a large temperature gradient occurs between the heated perimeter and the center of the lens/window. As a result, such approaches are characterized by a loss of efficiency as a "high" perimeter temperature must be maintained in order to provide sufficient heat at the center of the component to maintain or support the sought after optical effect.

Another current method to provide thermal energy to an optical lens or window is to apply a sheet, panel, or laminate of "clear" adhesive film to one surface of the optical component (see e.g., Briggs, III '003). Such films generally support a fine resistive wire, commonly by embedding or otherwise "capturing" the wire between layers thereof, or upon a layer surface, so as to form a resistive heating element or article (i.e., a fixation medium such as film "carries" a selectively configured resistive wire). The resistive wire can be located within or with respect to the film so as to selectively correspond/register with portions of the optical/transparent substrate (e.g., lens/window, etc.) where it is intended to provide optimal condensation/ice control. This method provides excellent thermal efficiency, however, as the adhesive film article overlies the entirety of the optical component, as "clear" as the film article may be, it nonetheless degrades the clarity of the lens/window (i.e., the application of the film increases the opacity of the lens/window), often times resulting in an unacceptable optical distortion.

A further current method to provide thermal energy to an optical lens or window is to apply a very thin coating/deposition of metal film, e.g., indium tin oxide (ITO), upon a substrate, e.g., polyester sheet or the like (see e.g., Ho et al. '519). In connection with such depositions, printed ink bus bars generally link the deposited metal film with crimped or adhesively bonded lead connections which extend from at least one bus bar end, and commonly both opposing bus bar ends. While this method or approach arguably provides improved optical performance in connection to transmittance and/or reflectance, thermal performance is generally less robust than that associated with adhesive film, and lead connections are generally believed less reliable than those associated with wire-element heaters.

For the most part, the latter film approaches, namely wire-element heating structures and thin-film coatings/depositions, have become the norm across most application fields, with each discussed and compared in a publication entitled "Comparison of Thin-film and Wire-element Heaters for Transparent Applications," Application Aid #30, Jul. 31, 2001, Minco Products, Inc., Minneapolis, Minn., incorporated herein by reference in its entirety. In as much as there no doubt are application criteria that support the selection of one heater style over the other, e.g., ITO film heaters provide an uninterrupted visible area, i.e., no shadows or light disruptions, whereas wire-element film heaters deliver more uniform heat flux and generally possess tighter resistance tolerances, with regard to heretofore known wire-element approaches, improvements in the area of light transmission are believed particularly advantageous and remain outstanding. Arguably, an improved thermally conditionable light transmitting subassembly would be characterized by an amalgamation of the advantageous features of each of the heretofore known approaches while if not eliminating, reducing the shortcomings of each.

In light of the foregoing, it is believed advantageous and desirable to provide a wire-element heater for transparent applications which possess a clarity/light transmittance on par with that presently available/associated with heretofore known thin film heaters while nonetheless offering: a greater range of electrical resistance; greater flexibility in profiling the resistance density across a surface/substrate; greater reliability due to the stability and durability associated with a solid/traditional wire; reliable and durable lead connections or the ability to obtain same; and, the ability to manufacture to tighter resistance tolerances in furtherance of reducing power consumption. Further still, it is believed advantageous and desirable to avoid thermal elements characterized by a laminate or substrate overlay for the prevention or remedying of condensate/ice formation on optical components/windows or the like. More particularly, it is believed especially advantageous to directly mate, as by bonding or the like, a thermal element in the form of a resistive wire to a light transmissive substrate in furtherance of providing greater clarity and/or light transmittance in excess of about 90%.

Thus, in furtherance of maintaining or restoring the optical integrity of articles and/or systems possessing a lens/window, it is believed advantageous to eliminate the heretofore known coextensive or substantially coextensive wire-element retaining media of adhesive films which overlie a lens/window (i.e., more generally a transparent substrate), while nonetheless retaining such precise and efficient heating of such heating structures.

SUMMARY OF THE INVENTION

A non-film based, thermally conditionable light transmitting article is provided. The article includes an adhesively coated resistive wire and a substrate suitably selected for light transmittance. The adhesively coated resistive wire is solely and directly adhesively affixed to the substrate so as to be thereby supported upon and by the substrate. A layer of adhesive, in the form of an adhesive linkage originating from the adhesive of the adhesively coated resistive wire, is present between the resistive wire and the substrate.

Advantageously, the resistive wire of the article of the subject invention, having a preferred diameter within a range of about 0.0008-0.003 inches, is characterized by a adhesive coating, more particularly, a B-stage adhesive applied to a thickness within a range of about 0.0002-0.0005 inches. An adhesive linkage, having origins in the adhesive of the adhesively coated wire and in the form of a "footprint," directly unites the resistive wire to/with the substrate, with a ratio of adhesive footprint width to wire diameter generally being less than about 6. More specific features and advantages obtained in view of the summary features will become apparent with reference to the drawing figures and DETAILED DESCRIPTION OF THE INVENTION.

DETAILED DESCRIPTION OF THE INVENTION

Figure 1:
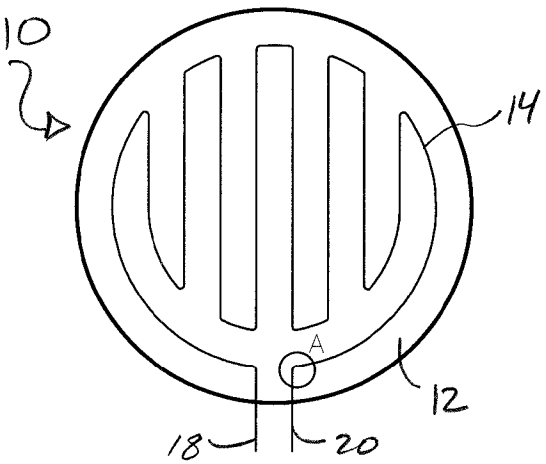
FIG. 1 depicts, in plan view, a representative thermally conditionable light transmitting article or subassembly of the subject invention.
Figure 2:
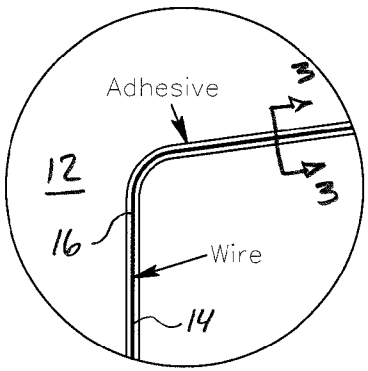
FIG. 2 is detailed view of area "A" of FIG. 1.
Figure 3:
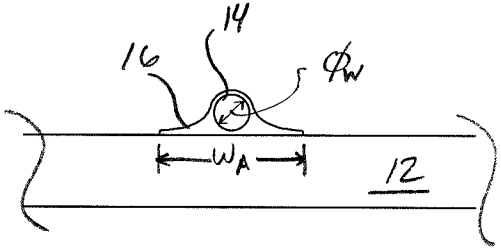
FIG. 3 is a view about line 3-3 of FIG. 2, namely, a depiction, in elevation, of elements of the subassembly and their interrelationships.

A contemplated, non-limiting representation of the article, subassembly or component of the subject invention is generally depicted in FIG. 1, with select diagrammatic details thereof provided in FIGS. 2 & 3. It is to be understood, and as should be readily appreciated, matters of size, configuration, component/material selection, etc. are dictated by functional objectives and/or performance requirements of a given application. Moreover, while the term "light" as used throughout this disclosure may have a contextual meaning in relation to visible light (i.e., the visible spectrum generally corresponding to wavelengths within a range of about 380-750 nm), it is nonetheless to be afford a broad reading and meaning, namely, the term is intended to also generally encompass electromagnetic energy or radiation beyond that associated with the visible spectrum.

With particular reference to FIG. 1, there is depicted a thermally conditionable light transmitting article 10 of the subject invention. As is appreciated with general reference to FIGS. 1-3, article 10 generally includes a substrate or base 12, a resistive heating element, advantageously in the form of resistive wire 14 as shown, and an adhesive linkage 16 directly joining wire 14 to and with substrate 12. In contradistinction to heretofore known approaches, absent from the subject article is the ubiquitous, perceived as necessary affixation media (e.g., the adhesive film of the wire-element film heaters) for "carrying" and permitting the application of a resistive wire to a substrate. Be that as it may, the subject article nonetheless retains the desirous well know thermal delivery properties of wire-element film heaters, more particularly, those properties not available in heretofore known thin/metallic films, while simultaneously possessing/exhibiting the perceived optical advantages of heretofore known thin film approaches or techniques.

The substrate 12 generally comprises a suitably selected light transmissive material in the form of, for example and without limitation, a film, sheeting, panel, etc., or a suitably selected light transmissive construct/assembly in the form of, for example and without limitation, a composite or laminate, coated material, etc. Broadly, substrates may take the form of a lens/lens system, lens cover, prism, platen, etc. and may be suitably but not necessarily fabricated from glass or polymers such as polyester.

The resistive wire 14 generally comprises copper, nickel or other well-known electrically resistive alloys, for example and without limitation, cupro-nickel, nickel-chrome, etc. The wire may or may not have an insulating, magnet wire-type coating. Generally, typical advantageous wire diameters fall within a range of about 0.0008-0.003 inches, however, they are not intended to be necessarily so limited.

With particular reference to FIG. 1, resistive wire 14 generally includes opposing free ends 18, 20, each of which is adapted, as in well known in the art, for integration with a voltage source via a lead attachment. By way of illustration only, opposing free ends of the resistive wire may be appropriately prepared in furtherance of micro-welding same to conductive tabs on a suitable assembly such as a flex circuit or the like. Consistent with a variety of aspects of the article or subassembly of the subject invention, lead attachment is highly application specific.

The adhesive linkage 16 advantageously but not necessarily comprises a thermosetting resin, more particularly, a partially cured B-stage adhesive. Functionally, it is advantageous that the adhesive be "dry" to the touch yet flowable with the application of suitable heat and/or pressure. In as much as adhesive selection is predicated upon a given application and/or substrate specification, epoxy, phenolic or polyamide based adhesives are contemplated and generally believed suitable as circumstances/conditions/functional parameters warrant or dictate.

The resistive wire heating element of the subject invention is advantageously coated, selectively or entirely as warranted, or otherwise suitably adorned with an application/component appropriate adhesive, more particularly, an adhesive linkage forming adhesive. A suitable adhesive coating thickness for the resistive wire is believed advantageously within a range of about 0.0002-0.0005 inches but is not intended to be necessarily so limited. Departures for such particulars are no doubt to be found owing to application specific conditions and/or the designation or selection material of elements of the article.

Subsequent to selectively configuring the coated resistive wire and indirect application of the so configured element to the substrate as by a release sheet or the like, or after direct application or introduction of the coated resistive wire to/upon the substrate as the case may be, heat and pressure are applied so as to effectively result in an operative, direct, fixed wire-to-substrate engagement as is generally depicted in FIGS. 2 & 3. More particularly, an operative engagement lacking an overlie that is coextensive or substantially coextensive with the substrate is provided (i.e., as should be readily appreciated with reference to the figures, there exists expanses of substrate free of material of any form; the substrate of the article of the subject invention, and thus the article itself, has a minimum of optical "distraction").

With continued reference to FIGS. 2 & 3, the article of the subject invention includes a "fillet" of adhesive (i.e., an adhesive linkage) deriving from or having origins in the adhesive of the adhesively coated resistive wire. Generally, the "width" of the resulting fillet ($W_A$) is within a range of about 0.002-0.010 inches, however, such feature is not intended to be necessarily so limited. Although a larger diameter wire may have a wider adhesive "footprint" (i.e., greater wire "heft"; greater adhesive bonding) this is not an absolute. As should be readily appreciated, the adhesive width is generally predicated upon sought after or required thermal conditioning, with factors such as durability (i.e., relative greater $W_A$) and optical clarity (i.e., relative lesser $W_A$) being assessment considerations. For the most part, it appears that a ratio of adhesive width $W_A$ to wire diameter ($\phi_W$) may be advantageously within a range of about 2-6, with less than 6 being a general rule for which there likely exists numerous exceptions.

In as much as the subject invention, including its elements and/or the relationships and interrelationships among and between same have been disclosed, the remainder of the instant disclosure takes up the particulars of the subject invention in a non-limiting exemplary application/component embodiment. More particularly, in connection to the maintenance of an ice/frost/condensation-free sensing window for an optically guided munition, preferred embodiment particulars of the subject invention follow.

The sensing window of the optically guided munition (i.e., an embodiment of the article, subassembly or component of the subject invention) advantageously includes a 0.0011 inch annealed copper wire, available from Kanthal Palm Coast (FL), bearing a coating of thermosetting B-staged epoxy resin bondcoat at a nominal thickness of about 0.00025 inches, also available from Kanthal Palm Coast, supported upon a substrate comprising a 0.002 inch thick Melinex® 454 polyester film available from Dupont-Teijin Films (VA). The adhesive bearing wire is routed/configured so as to produce an approximately 1 inch diameter heater pattern, with typical heater "strand" spacing (i.e., distance between adjacent wire segments/portions in what is a generally parallel spacing of substrate traversing segments/portions) on the order of about 0.065 inches.

Heat and pressure are use to transfer the patterned wire from a temporary carrier to the optically clear substrate material. Heat and pressure flow the wire adhesive to an optimal width within a range of about 0.004-0.006 inches which provides a robust anchored interface between the wire and the substrate. As a result, with an optimal wire adhesive flow width within the range of about 0.004-0.006 inches, coupled with 0.065 inch wire/heater strand spacing, an optical window transparency of in excess of about 90% is thereby provided.

It is to be understood that there are other variations of the subject invention, some of which will become obvious to those skilled in the art. Moreover, it is to further be understood that this disclosure, in many respects, is only illustrative. Changes may be made in details, particularly in matters of shape, size, material, and arrangement of parts, as the case may be, without exceeding the scope of the invention.

What is claimed is:

1. A transparent resistively heated article comprising a transparent substrate and a resistive heating element, said resistive heating element comprising an adhesively coated resistive wire, said resistive heating element adhesively affixed to said transparent substrate for support thereby via adhesion of said adhesively coated resistive wire to said transparent substrate via a fillet of adhesive deriving from adhesive of said adhesively coated resistive wire.

2. The article of claim 1 wherein said transparent substrate comprises an optical element.

3. The article of claim 1 wherein said transparent substrate comprises a lens.

4. The article of claim 1 wherein said transparent substrate comprises a lens cover.

5. The article of claim 1 wherein said transparent substrate comprises a prism.

6. The article of claim 1 wherein said transparent substrate comprises a platen.

7. The article of claim 1 wherein said transparent substrate comprises glass.

8. The article of claim 1 wherein said transparent substrate comprises a polymer.

9. The article of claim 1 wherein said adhesively coated resistive wire comprises an electrically conductive wire having a diameter in a range of about 0.0008-0.003 inches.

10. The article of claim 9 wherein said electrically conductive wire comprises copper.

11. The article of claim 9 wherein said electrically conductive wire comprises a copper alloy.

12. The article of claim 9 wherein said electrically conductive wire comprises nickel.

13. The article of claim 9 wherein said electrically conductive wire comprises a nickel alloy.

14. The article of claim 1 wherein said electrically conductive wire occupies a periphery of said transparent substrate.

15. The article of claim 1 wherein said electrically conductive wire repeatedly traverses said transparent substrate.

16. The article of claim 1 wherein said adhesively coated resistive wire comprises a thermosetting resin.

17. The article of claim 1 wherein said adhesively coated resistive wire comprises a partially cured B-stage adhesive.

18. The article of claim 1 wherein an adhesive coating thickness for said adhesively coated resistive wire is within a range of about 0.0002-0.0005 inches.

19. The article of claim 1 wherein an adhesive coating of said adhesively coated resistive wire comprises a B-stage adhesive.

20. The article of claim 1 wherein an adhesive coating of said adhesively coated resistive wire comprises a bondcoat selected from the group consisting of epoxy, phenolic or polyamide resin.

21. A thermally conditionable subassembly for light transmission, said subassembly comprising a light transmissive substrate and a resistive heater supported thereby, said resistive heater comprising an electrically conductive wire have a diameter of less than about 0.003 inches, an adhesive linkage interposed between said electrically conductive wire and said light transmissive substrate so as to unite same.

22. A non-film based, thermally conditionable light transmitting article comprising a resistive wire and a substrate suitably selected for light transmittance, said resistive wire solely and directly adhesively affixed to said substrate so as to be thereby supported upon and by said substrate, a layer of adhesive present between said resistive wire and said substrate.

23. The article of claim 22 wherein a ratio of a width of said layer of adhesive to a diameter of said resistive wire is within a range of about 2-6.

24. The article of claim 22 wherein a ratio of a width of said layer of adhesive to a diameter of said resistive wire is less than about 6.

25. The article of claim 22 wherein said resistive wire is solely and directly adhesively affixed to said substrate at preselect portion of a length thereof.

26. The article of claim 22 wherein said resistive wire is solely and directly adhesively affixed to said substrate throughout a substantial portion of a length thereof.

27. The article of claim 22 wherein said resistive wire is solely and directly adhesively affixed to said substrate throughout an entirety of a length thereof.

28. The article of claim 22 wherein said resistive wire includes opposing free ends adapted for connection to a voltage source.

29. The article of claim 25 wherein said resistive wire is solely and directly adhesively affixed throughout a length extending between said opposing free ends thereof.

30. The article of claim 25 wherein said resistive wire is solely and directly adhesively affixed throughout select portions of a length extending between said opposing free ends thereof.

31. A transparent resistively heated article comprising a transparent substrate and a resistive heating element, said resistive heating element comprising an adhesively coated resistive wire, said resistive heating element adhesively affixed to said transparent substrate for support thereby via adhesion of said adhesively coated resistive wire to said transparent substrate via a fillet of adhesive deriving from adhesive of said adhesively coated resistive wire, a resistive wire of said adhesively coated resistive wire having a diameter within a range of about 0.0008-0.003 inches, a coating of adhesive of said adhesively coated resistive wire having a thickness within a range of about 0.0002-0.0005 inches.

32. A light transmissive resistively heated article comprising an operative union of:

a. a selectively configured, adhesively coated resistive wire, a resistive wire of said selectively configured, adhesively coated resistive wire having a diameter within a range of about 0.0008-0.003 inches, an adhesive of said selectively configured, adhesively coated resistive wire having a thickness within a range of about 0.0002-0.0005 inches; and, b. a light transmissive substrate, the operative union of said selectively configured, adhesively coated resistive wire and said light transmissive substrate delimiting an optical window for the light transmissive resistively heated article characterized by portions whose cross Section comprises only said light transmissive substrate.

33. The article of claim 32 wherein said light transmissive substrate comprises an optical element.

34. The article of claim 32 wherein said light transmissive substrate comprises a lens.

35. The article of claim 32 wherein said light transmissive substrate comprises a lens cover.

36. The article of claim 32 wherein said light transmissive substrate comprises a prism.

37. The article of claim 32 wherein said light transmissive substrate comprises a platen.

38. The article of claim 32 wherein said light transmissive substrate comprises glass.

39. The article of claim 32 wherein said light transmissive substrate comprises a polymer.

* * * * *